US006698529B2

(12) United States Patent
Coombs et al.

(10) Patent No.: US 6,698,529 B2
(45) Date of Patent: Mar. 2, 2004

(54) TRANSLATING TURRET ROCK BOLTER

(75) Inventors: Perry L. Coombs, Claremont, NH (US); Ward D. Morrison, Claremont, NH (US); Paul R. Bigoney, Newport, NH (US)

(73) Assignee: Oldenburg Cannon, Inc., Claremont, NH (US)

( * ) Notice: Subject to any disclaimer, the term of this patent is extended or adjusted under 35 U.S.C. 154(b) by 1 day.

(21) Appl. No.: 10/124,611

(22) Filed: Apr. 17, 2002

(65) Prior Publication Data

US 2003/0066665 A1 Apr. 10, 2003

(Under 37 CFR 1.47)

Related U.S. Application Data

(60) Provisional application No. 60/285,194, filed on Apr. 20, 2001.

(51) Int. Cl.[7] ..... B23Q 5/00; E21B 15/04

(52) U.S. Cl. ..... 173/4; 173/32; 173/42; 173/193; 405/259.1; 405/303

(58) Field of Search ..... 173/32, 38, 39, 173/42, 193–195, 4, 11, 19, 44; 405/259.1, 303

(56) References Cited

U.S. PATENT DOCUMENTS

| | | | | | |
|---|---|---|---|---|---|
| 3,196,957 | A | * | 7/1965 | Ottosson et al. | 173/194 |
| 3,381,762 | A | * | 5/1968 | Lewis et al. | 173/193 |
| 3,613,804 | A | * | 10/1971 | Jonsson | 173/32 |
| 4,158,520 | A | * | 6/1979 | Prebensen | 405/259.1 |
| 4,226,559 | A | * | 10/1980 | Prebensen | 405/303 |
| 4,473,325 | A | * | 9/1984 | Beney et al. | 405/303 |
| 4,497,378 | A | | 2/1985 | Beney et al. | 173/32 |
| 4,832,536 | A | * | 5/1989 | Spross et al. | 405/303 |
| 5,114,279 | A | * | 5/1992 | Bjerngren et al. | 405/303 |
| 5,116,164 | A | * | 5/1992 | Casagrande | 405/303 |
| 5,246,313 | A | * | 9/1993 | Combet et al. | 405/303 |
| 5,597,267 | A | | 1/1997 | Morrison et al. | |
| 6,105,684 | A | * | 8/2000 | Pointer et al. | 173/193 |

FOREIGN PATENT DOCUMENTS

| | | | | |
|---|---|---|---|---|
| EP | 0034134 A1 | * | 8/1981 | E21D/20/00 |
| EP | 0216506 A1 | * | 4/1987 | E21D/20/00 |

* cited by examiner

*Primary Examiner*—Stephen F. Gerrity
(74) *Attorney, Agent, or Firm*—Michael T. Weins; Jeffrey E. Semprebon

(57) ABSTRACT

A rock bolter has a turret assembly having a positionable base. The base slidably and rotatably engages a cylindrical member on which a feed track support is affixed. A jack rotatably and slidably engages the cylindrical member, but cannot translate with respect to the base. The jack has a piston connected to the feed track support, and extending or retracting the piston translates the cylindrical member relative to the base to move the feed track support toward and away from a rock surface. A stinger assembly connected to the base engages the rock surface to stabilize the turret assembly. A pivot actuator connected between the base and the jack rotates the jack and the feed track support to selectively place either a drill or a bolt driver in alignment with a desired location on the rock surface.

9 Claims, 7 Drawing Sheets

TRANSLATING TURRET ROCK BOLTER

FIELD OF THE INVENTION

The present invention is for a rock bolter which drills holes and sets bolts for stabilizing the roof and walls of mines, and more particularly for a rock bolter which can set bolts into rough rock surfaces while remaining compact in overall size.

BACKGROUND OF THE INVENTION

Rock bolters have been developed to drill holes and set bolts to stabilize rock walls in mines and similar excavations. One type of rock bolter is the turret rock bolter, which typically has two feed tracks. One feed track directs a rock drill as it advances toward a rock surface to bore a hole into which a bolt is to be set, while a second feed track directs a bolt driver as it is advanced toward the rock surface to set the bolt into the hole. The feed tracks are sequentially rotated into a work position where the drill or the rock bolter residing thereon is in alignment with a particular location on the rock surface, and the rock drill or bolt driver is then advanced along its feed track to the rock surface. First, the drill is placed in the work position and advanced to drill a hole in the rock surface at the desired location. The drill is then withdrawn from the hole, and the turret is rotated to place the bolt driver in the work position, aligned with the hole. The bolt driver is then advanced to set the bolt into the hole. A stinger assembly is usually employed to engage the rock surface to stabilize the turret during the bolt setting process, in which case the turret typically rotates about an axis extending through the stinger assembly.

In many instances, the rock surface into which bolts are to be set is uneven, which limits the ability to rotate the feed tracks when they are positioned in close proximity to the rock surface. In an attempt to overcome this problem, U.S. Pat. No. 4,497,378 teaches a turret rock bolter where the feed tracks are translated away from the rock surface before rotating to allow the turret to rotate when the feed tracks are spaced further from the rock surface.

FIG. 1 is a schematic representation of the basic elements of the turret rock bolter taught in the '378 patent. The rock bolter has a turret 10 having a support base 12 which is connected to a boom 14 for positioning the turret 10. A first cylindrical member 16 is fixed to the support base 12 and has an anchoring point 18 on one end. When the boom 14 is moved to position the anchoring point 18 against a rock surface (not shown), the anchoring point 18 engages the rock surface to act as a stinger.

A pair of spaced-apart bearing brackets 20 are rotatably and slidably mounted on the first cylindrical member 16, and a feed track support 22 is fixed to the bearing brackets 20 so as to extend parallel to the first cylindrical member 16. A drill track 24 and a bolt driver track 26 are provided on the feed track support 22. A rock drill 28 is longitudinally movable along the drill feed track 24, while a bolt driver 30 is longitudinally movable along the bolt driver track 26. An advancing mechanism 32 is employed to selectively move the rock drill 28 and the bolt driver 30 along their respective feed tracks (24, 26). In the rock bolter of the '378 patent, the advancing mechanism 32 employs a system of pulleys 34 to allow a single advancing piston 36 to move either the drill 28 or the bolt driver 30 when the other of the two is immobilized.

To translate the feed track support 22 away from the rock surface, providing greater space for rotation, a translating piston 38 is mounted to the first cylindrical member 16 and is rotatably mounted to the feed track support 22. When the translating piston 38 is extended, the feed track support 22 is moved such that the separation of the drill feed track 24 and the bolt driver feed track 26 from the rock surface is increased.

To pivot the feed track support 22 to position either the drill 28 or the rock bolter 30 in alignment with a work axis 40, a second cylindrical member 42 is fixed to the bearing brackets 20. A pivot link 44 is rotatably mounted on the first cylindrical member 16 and both slidably and rotatably engages the second cylindrical member 42. A pivot piston 46 is connected at one end to the support 12, and at the other end to the pivot link 44. By extending and retracting the pivot piston 46, the pivot link 44 is rotated with respect to the first cylindrical member 16. The second cylindrical member 42, the bearing brackets 20, and the feed track support 22 rotate with the pivot link 44, and thus the feed track support 22 is rotated to position either the drill 28 or the rock bolter 30 in alignment with the work axis 40.

While the rock bolter of the '378 patent allows translating the feed tracks away from the rock surface to facilitate rotation, it requires a complex structure to accomplish such action. The rock bolter has multiple, widely spaced bearings, which complicates the task of keeping the bearings protected from dirt and adequately lubricated. Furthermore, the use of the translating piston 38 to translate the feed track support 22 toward and away from the rock surface can result in binding. Because the translating piston 38 is mounted to one end of the first cylindrical member 16, forces on the various bearings are unbalanced, and must be transmitted long distances through other elements of the structure. The slidable bearing between the pivot link 44 and the second cylindrical member 42 can be particularly problematic, since it is not only axially spaced apart from the translating piston 38, but is also positioned on a different axis and thus is highly subject to torque. Because the feed track support 22 must rotate with respect to the translating piston 38, all translation forces must be transmitted through the pivotable connection between these two elements, placing great strain on this connection.

Thus, there is a need for a turret rock bolter which allows translation of the feed track support while overcoming the deficiencies of the device discussed above.

SUMMARY OF THE INVENTION

The rock bolter of the present invention employs a turret assembly where a boom is employed to position the turret assembly at a desired location with respect to a rock surface. The turret assembly has a base which is connectable to the boom. The connection of the base to the boom may include one or more knuckles, roll actuators, or similar devices known in the art for further adjusting the position and orientation of the turret assembly. The base may also serve to support other elements of the rock bolter, such as a bolt magazine for supplying a number of bolts and bolt plates sequentially to the bolt driver, such as taught in U.S. Pat. No. 5,597,267.

The base has at least one base bearing, and preferably a pair of spaced-apart base bearings. The at least one base bearing slidably and rotatably engages a cylindrical member having a cylinder axis. The cylindrical member terminates in a cylinder first end region and a cylinder second end region. A pair of spaced-apart brackets are fixably connected to the cylindrical member, with the base residing therebetween. One of the brackets is fixed to the cylinder first end region, while the other is fixed to the cylinder second end region.

Attached to the brackets is a feed track support which extends parallel to the cylindrical member. The feed track support has a drill feed track and a rock bolter feed track mounted thereon, and the feed tracks can be formed as integral parts of the feed track support. A rock drill is longitudinally movable along the drill feed track, and typically is mounted to the drill feed track via a drill carriage. The drill has a drill steel for drilling a hole in the rock surface as the drill is advanced along the drill feed track. A bolt driver is longitudinally movable along the bolt driver feed track support, and typically is mounted to the bolt driver feed track by a bolt driver carriage. The bolt driver, when advanced along the bolt driver feed track, advances a bolt into a hole bored by the drill.

Preferably, the base is configured such that the feed track support faces the operator of the rock bolter to provide the operator clear visibility of the drill and the rock bolter during the bolt setting process.

An advancement mechanism is provided for selectively moving the drill and the bolt driver along their respective feed tracks. Such advancement mechanisms are known in the art, such as the mechanism taught in U.S. Pat. No. 4,497,378 and discussed above, which employs single actuator for advancing both the drill and the bolt driver.

A jack is provided, having a jack body with at least one jack bearing which is rotatably mounted on the cylindrical member between the pair of brackets, and thus is rotatable relative to the base about the cylinder axis. The at least one jack bearing is also slidably engaged with the cylindrical member. The jack has at least one extendable piston which can be extended from the jack body and is connected to one of the brackets attached to the cylindrical member.

Means are provided for limiting translation between the at least one jack bearing and the at least one base bearing of the base such that the jack is allowed only very limited or, more preferably, no translational motion with respect to the base. Thus, when the cylinder translates relative to the base, it also translates relative to the jack body as well. The means for limiting translation of the at least one jack bearing with respect to the at least one base bearing can be provided by various means, such as by employing paired bearings positioned on either side of another bearing and constrainably engaging it either directly or via spacers, or by providing a bracket on either the base or the jack positioned to constrain the translational motion of a bearing. Preferably, a pair of base bearings are employed with a single jack bearing positioned therebetween and constrained thereby. In addition to providing a simple structure for constraining translational motion of the jack with respect to the base, the pair of base bearings and the jack bearing can be positioned adjacent to each other to provide reduced exposure of the individual bearings to dirt and debris.

Since translation of the jack body with respect to the base is limited, extending or retracting the at least one piston of the jack relative to the jack body provides a motivating force to translate the cylindrical member relative to the base and the jack. Preferably, the jack is a dual-action jack, having a pair of opposed pistons extending from either end of the jack body and moving in coordination, the opposed pistons each being attached to one of the pair of brackets. The use of opposed pistons provides more balanced forces on the translating elements to minimize binding. In all cases, when the at least one piston of the jack is activated, it moves the brackets relative to the one or more jack bearings, and the cylindrical member which is affixed to the brackets is moved longitudinally relative to the base. The feed tracks, which are fixed relative to the cylindrical member, are thus moved toward and away from the rock surface.

Since the at least one piston of the jack is attached to the brackets which are in turn affixed to the cylindrical member, the jack rotates with respect to the base about the cylinder axis in coordination with the cylindrical member.

A stinger assembly is provided, which is brought into engagement with the rock surface to stabilize the base during the drilling and bolt setting process. The stinger assembly is connected to the base either by attaching it thereto or by linking the stinger assembly to the base so as to avoid translational motion of the base in a direction parallel to the cylinder axis of the cylindrical member. The stinger assembly preferably has a stinger fixed portion which includes a stinger support structure that is affixed to either the base or the jack. It is further preferred for the stinger support structure to be configured to provide engagement with the rock surface at a point which lies along the cylinder axis.

Preferably, the stinger assembly has a stinger extendable portion which is extendably attached to the stinger fixed portion and terminates in a rock-engaging pad which is advanced toward the rock surface when the stinger extendable portion is extended. Preferably, the extension of the stinger extendable portion is provided by a linear actuator operating between the rock-engaging pad and the stinger support structure to eliminate the need to position the rock-engaging pad against the rock surface solely by motion of the boom. When the stinger support structure is mounted to the jack, it is preferred for the rock-engaging pad to be rotatable with respect to the stinger fixed portion.

A pivot actuator is operably connected between the base and the jack. When activated, the pivot actuator rotates the jack relative to the base about the cylinder axis. Since the feed track support is fixed to the brackets which in turn are affixed to the at least one piston of the jack, the feed track support rotates with the jack. Thus, the pivot actuator serves to rotate the feed track support to selectively place either the drill or the bolt driver in alignment with a desired location on the rock surface where the rock bolt is to be placed. When the drill has been positioned, it can be advanced along the drill feed track to bore a hole in the rock surface at the desired location. After the drill is withdrawn, the pivot actuator is activated to rotate the feed track support to place the bolt driver in alignment with the hole, and the bolt driver can thereafter be advanced to insert a bolt into the hole.

In one preferred embodiment, the pivot actuator is provided by a pivot linear actuator which is pivotably connected at one end to the base and at the other end to the jack. The pivot linear actuator is offset from the cylinder axis, and rotates the jack relative to the base as the pivot linear actuator is extended and retracted.

In use, the boom of the rock bolter is employed to position the turret assembly in a desired location and orientation relative to the rock surface, and the stinger assembly is engaged with the rock surface. When the stinger assembly includes a stinger extendable portion, the boom need only position the stinger assembly in close proximity to the rock surface, and the stinger extendable portion is then extended to engage the stinger assembly with the rock surface. At this time, the drill is positioned by the pivot actuator in alignment with the desired location for placement of the bolt if it is not already so aligned. If the jack is positioned so as to place the feed tracks at a substantial separation from the rock surface, the jack is activated to move the feed tracks in closer proximity to the rock surface.

The drill is then advanced along the drill feed track to bore a hole into the rock surface at the desired location. The drill is then withdrawn from the rock surface along the drill feed track and, if necessary, the jack is activated to move the feed track support away from the rock surface. If the rock surface is relatively flat, and there is sufficient space in close proximity to the rock surface to rotate the feed track support, withdrawal of the feed track support away from the rock surface is not required.

To move the bolt driver into alignment with the bolt hole, the pivot actuator is activated to rotate the jack and feed track support about the cylinder axis. The jack is then activated, if necessary, to bring the bolt driver feed track into close proximity to the rock surface, and the bolt driver is advanced to insert the bolt into the hole bored by the drill.

BRIEF DESCRIPTION OF THE FIGURES

In FIG. 2, the feed track support is positioned to align a rock drill with a desired location on a rock surface and is advanced towards the rock surface to facilitate drilling a bolt hole thereinto. A stinger assembly mounted to the base engages the rock surface to stabilize the rock bolter.

BEST MODE OF CARRYING THE INVENTION INTO PRACTICE

Figure 1:
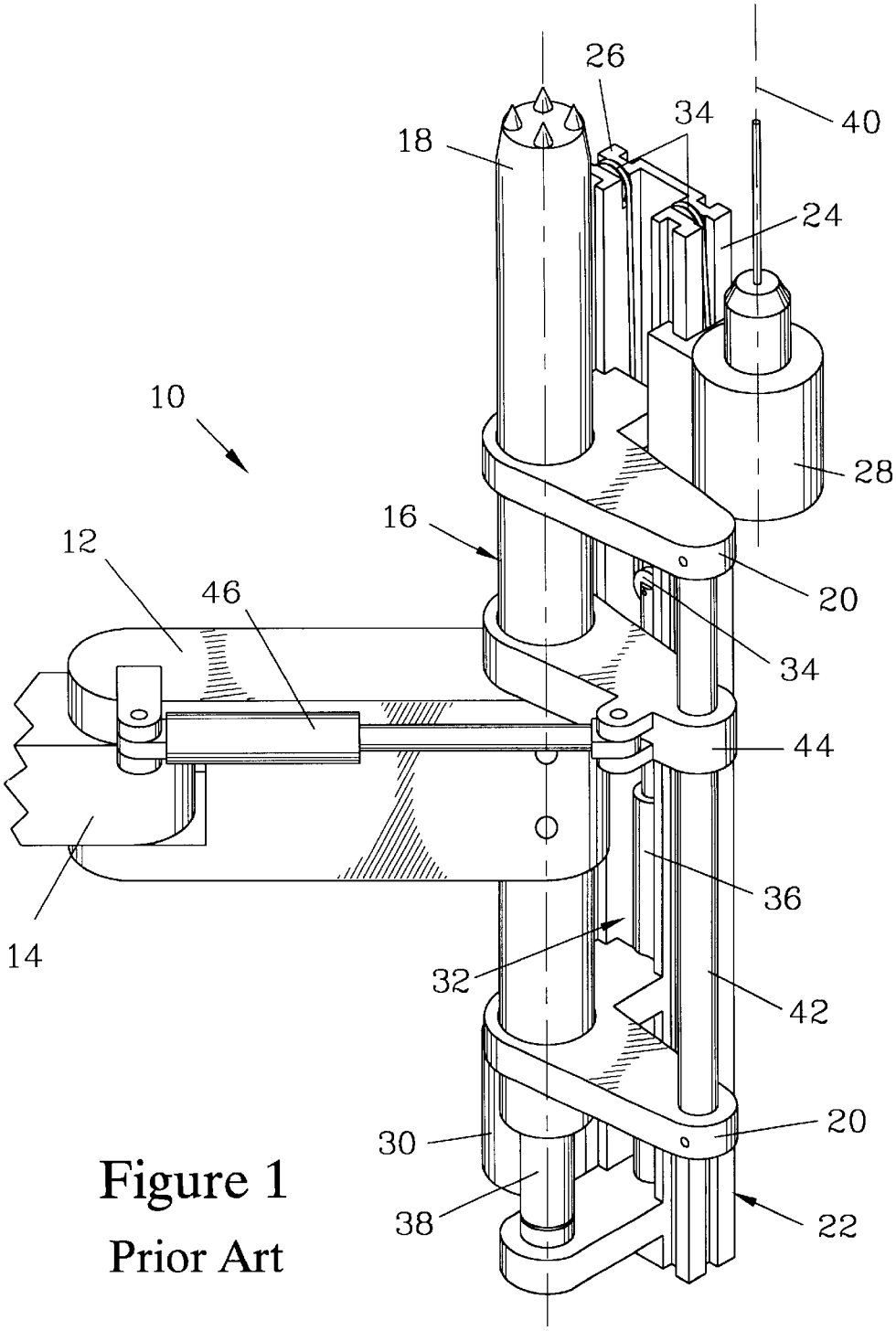
Figure 1 Prior Art
FIG. 1 is an isometric view of a prior art turret rock bolter where a pair of feed tracks can be translated with respect to a base.

FIGS. 2 through 5 illustrate a turret assembly 100 which forms one embodiment of the present invention. The turret assembly 100 has a base 102 which is connected to a boom 104 of a rock bolter (not shown). The boom 104 serves to position the turret assembly 100 in a desired location to install a rock bolt 106 (shown in FIGS. 4 and 5) into a rock surface 108.

In this embodiment, the base 102 has a pair of base bearings 110 which are spaced apart and are fixably positioned on the base 102 opposite the point of attachment to the boom 104. A cylindrical member 112 is slidably and rotatably mounted to the base bearings 110 such that it can both translate with respect to the base 102 along a longitudinal cylinder axis 114 and pivot with respect to the base 102 about the cylinder axis 114. The cylindrical member 112 terminates in a cylinder first end region 116 and a cylinder second end region 118. A pair of brackets 120 are fixed onto the cylindrical member 112, one positioned at each of the cylinder first end region 116 and the cylinder second end region 118, such that the base bearings 110 reside between the pair of brackets 120.

Figure 2:
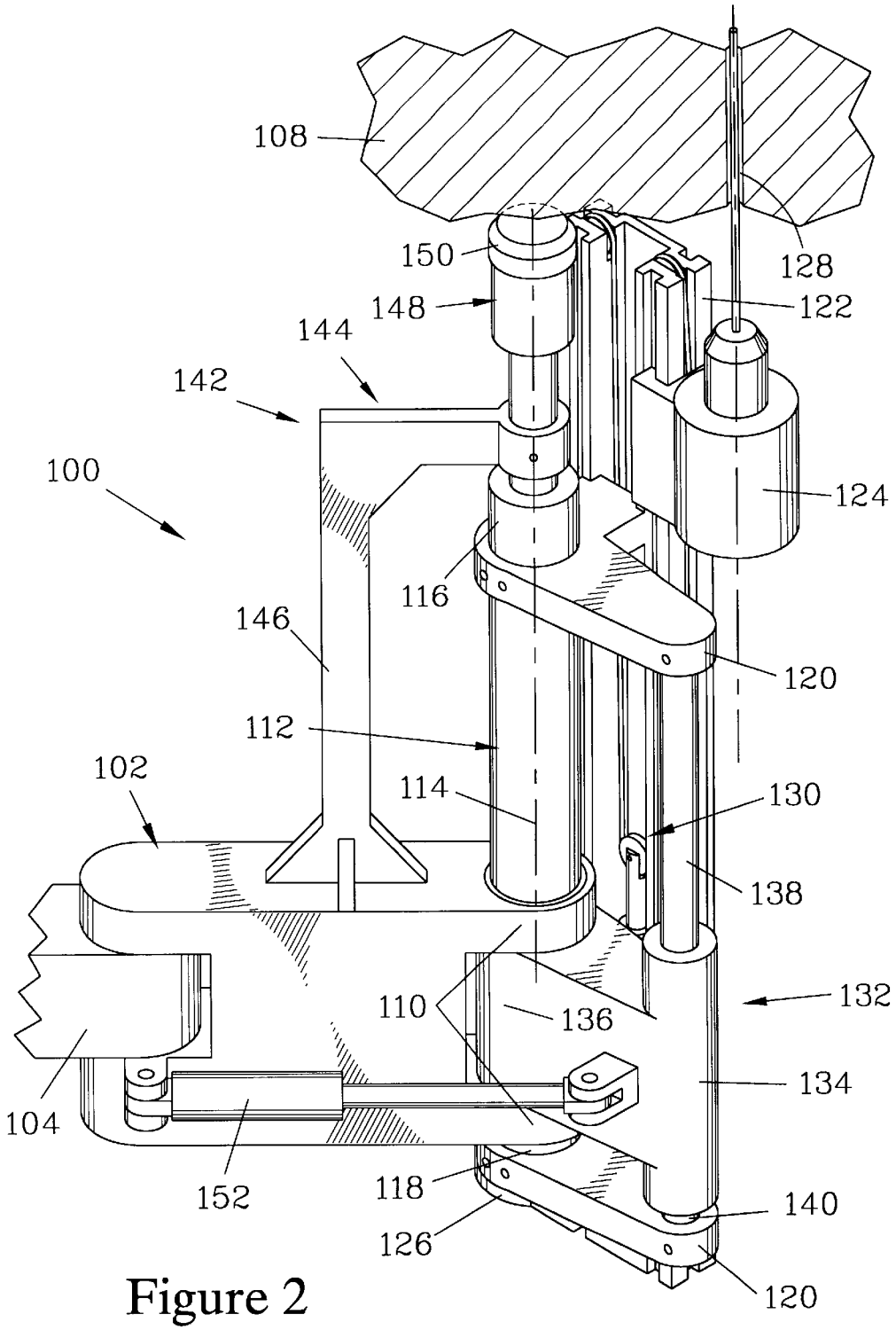
FIG. 2 is an isometric view illustrating a turret rock bolter which forms one embodiment of the present invention. A base of the rock bolter has a pair of base bearings which slidably and rotatably engage a cylindrical member which in turn is affixed to a pair of brackets. A feed track support is mounted to the brackets, and can be translated with respect to the base by a dual-action jack which is rotatably engaged with the cylindrical member.
Figure 5:
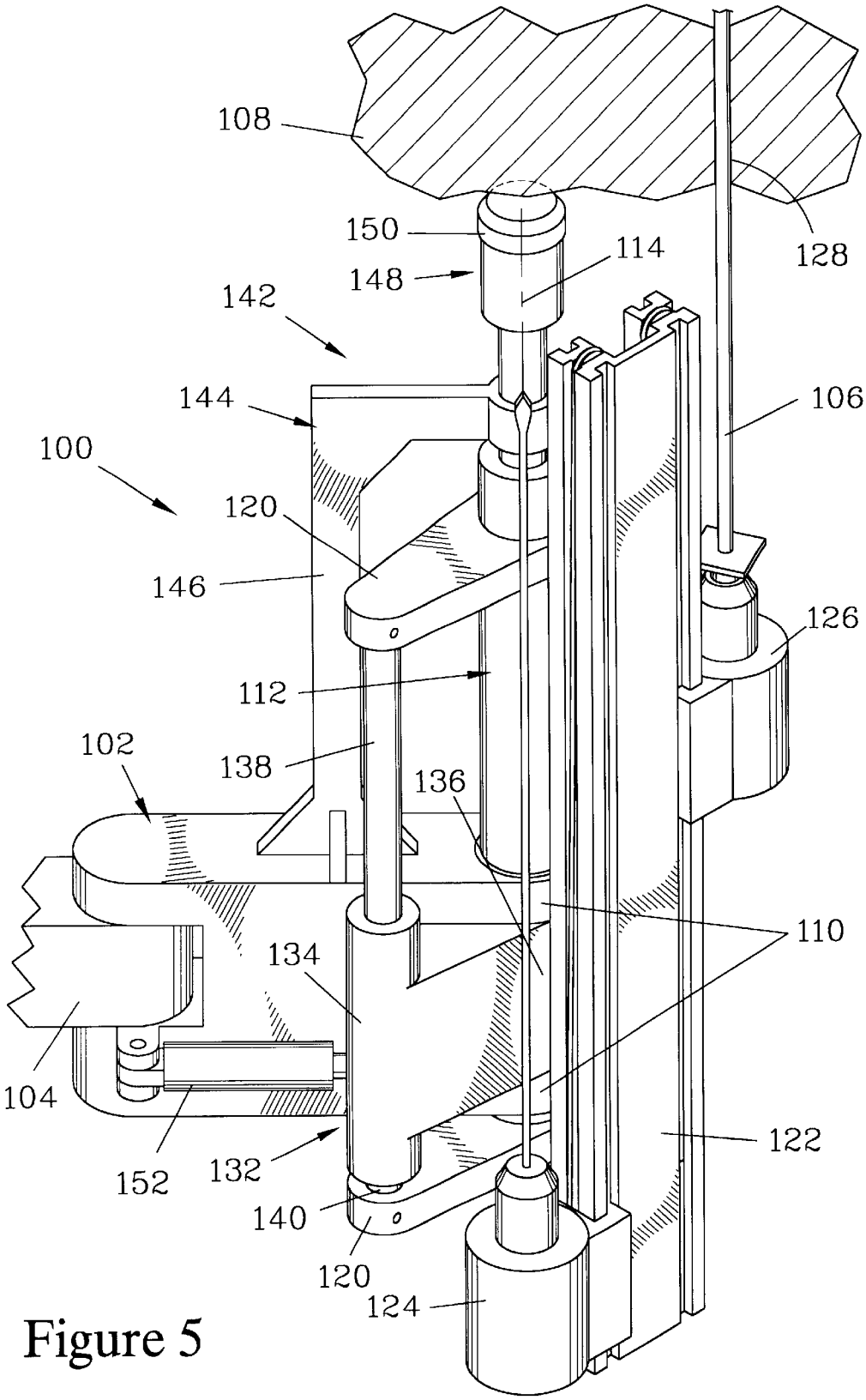
FIG. 5 illustrates the embodiment shown in FIGS. 2–4 where the dual-action jack has again been activated, to move the feed track support into closer proximity to the rock surface to facilitate insertion of a bolt into the bolt hole by the bolt driver.

A feed track support 122 is affixed onto the pair of brackets 120 and extends parallel to the cylinder axis 114. The feed track support 122 supports a drill 124 and a bolt driver 126. The drill 124 can be advanced along the feed track support 122 to drill a bolt hole 128 into the rock surface 108, as shown in FIG. 2. When the drill 124 is advanced, it is preferred for the feed track support 122 to be located in close proximity to the rock surface 108 to maximize the depth of the bolt hole 128 which can be drilled. Similarly, when aligned with the bolt hole 128, the bolt driver 126 can be advanced to insert the rock bolt 106 into the bolt hole 128, as shown in FIG. 5. An advancing mechanism 130 is employed to selectively advance either the drill 124 or the bolt driver 126 along the feed track support 122. In this embodiment, the advancing mechanism 130 employs a pulley and piston system mounted to the feed track support 122, such as the advancing system described in U.S. Pat. No. 4,497,378, incorporated herein by reference.

The slidable engagement between the cylindrical member 112 and the base bearings 110 allows the feed track support 122, which is affixed to the cylindrical member 112 by the pair of brackets 120, to translate toward or away from the rock surface 108, while the rotatable engagement between the cylindrical member 112 and the base bearings 110 allows the feed track support 122 to be pivoted to move the bolt driver 126 into alignment with the bolt hole 128 after it is has been bored by the drill 124. As the feed track support 122 is pivoted, it sweeps out a region in space. When the rock surface 108 is uneven with a high degree of relief, there is frequently insufficient space in close proximity to the rock surface 108 to pivot the feed track support 122. For this reason, it is often necessary to move the feed track support 122 to increase its separation from the rock surface 108 to provide room for the feed track support 122 to pivot.

In this embodiment, a dual-action jack 132 is provided to control the translation of the feed track support 122. The dual-action jack 132 of this embodiment has a jack body 134 with a single jack bearing 136 affixed thereto. The jack bearing 136 rotatably and slidably engages the cylindrical member 112.

The dual-action jack 132 has a first piston 138 and a second piston 140, which move in coordination and extend from opposite sides of the jack body 134. The first piston 138 and the second piston 140 are each attached to one of the pair of brackets 120, and the use of the dual-action jack 132 connected to both of the pair of brackets 120 provides increased stability for the feed track support 122. The dual-action jack 132 can be selectively activated to extend the first piston 138 while retracting the second piston 140, or to extend the second piston 140 while retracting the first piston 138.

In this embodiment, means for limiting translation of the jack bearing 136 with respect to the base bearings 110 is provided by having the jack bearing 136 engage the base bearings 110 such that the base bearings 110 bracket the jack bearing 136 to prevent translation. Thus, while the jack body 134 is slidably engaged with respect to the cylindrical member 112 via the jack bearing 136, the jack body 134 is effectively limited from translating with respect to the base 102. When the cylindrical member 112 slides, it translates with respect to both the base 102 and the dual-action jack 132. While the dual-action jack 132 is not effectively translatable with respect to the base 102, the rotatable engagement between the base bearings 110 and the cylindrical member 112 allows the dual-action jack 132 to pivot with respect to the base 102 about the cylinder axis 114. It should be noted that the dual-action jack 132 would be able to rotate with respect to the cylindrical member 112, but is prevented from such rotation by the connection of first piston 138 and the second piston 140 to the pair of brackets 120. Thus, the dual-action jack 132, the feed track support 122, and the cylindrical member 112 pivot together about the cylinder axis 114.

Figure 3:
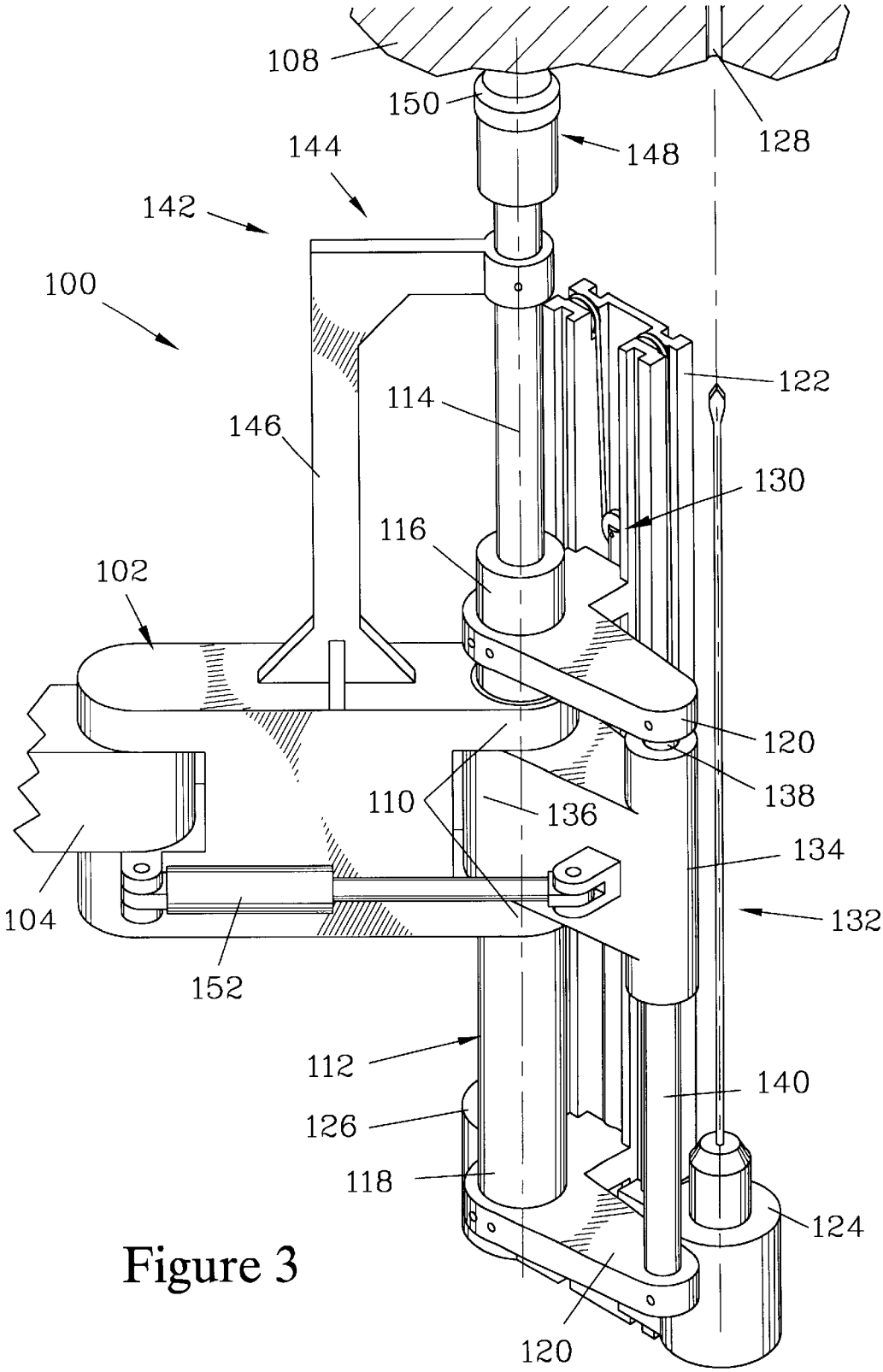
FIG. 3 illustrates the embodiment shown in FIG. 2 where the dual-action jack has been activated to move the feed track support to a position of increased separation from the rock surface prior to pivoting the feed track support.
Figure 4:
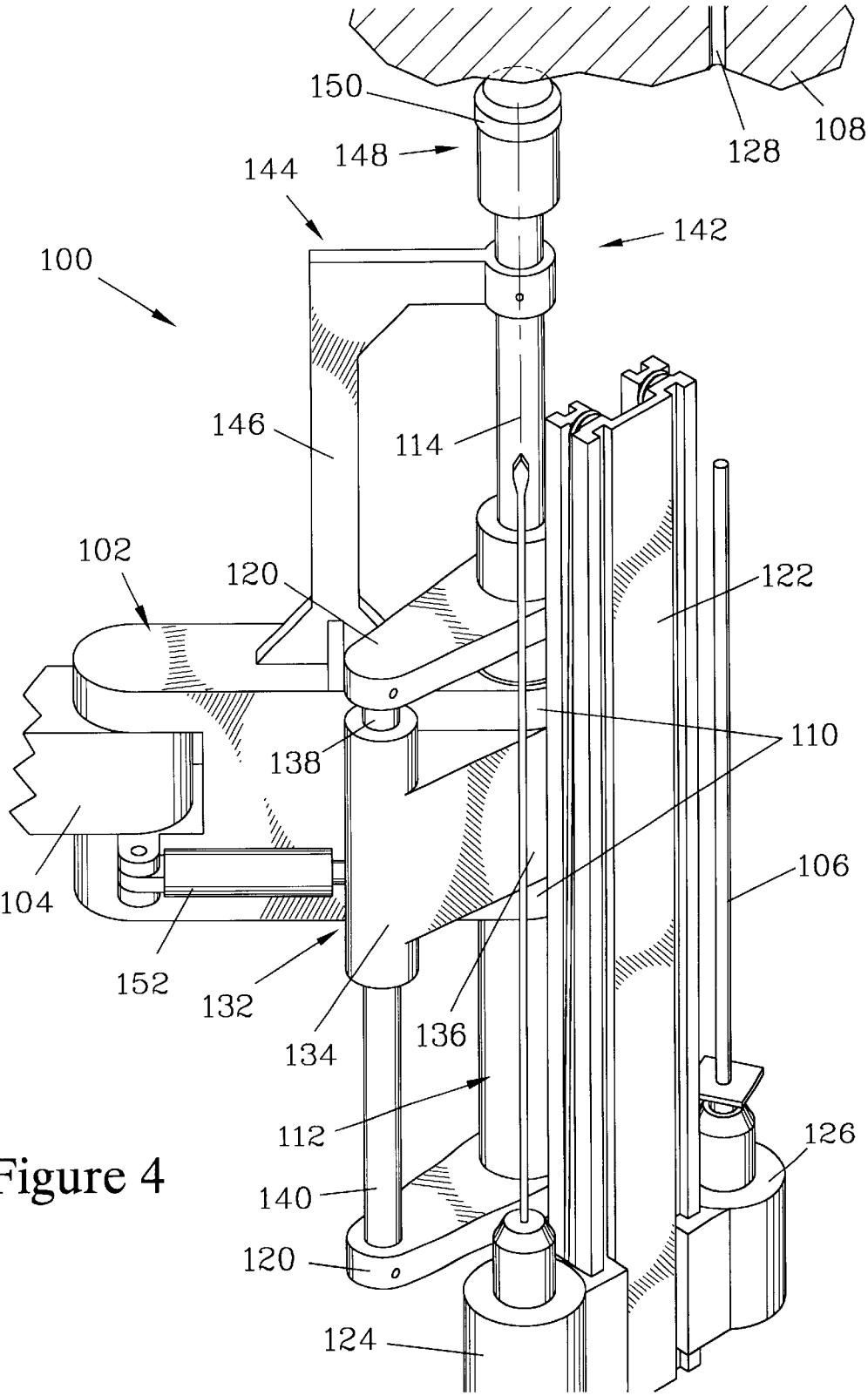
FIG. 4 illustrates the embodiment shown in FIGS. 2 and 3 where a pivot actuator has been activated to move the feed track support to place a bolt driver into alignment with the bolt hole. Since the feed track support is withdrawn from the rock surface, the pivoting of the feed track support is not impeded by unevenness of the rock surface.

When the bolt hole 128 is to be drilled, the dual-action jack 132 is activated to extend the first piston 138 and retract the second piston 140, placing the feed track support 122 in close proximity to the rock surface 108, as shown in FIG. 2. The drill 124 is then advanced to drill the bolt hole 128. After the bolt hole 128 is completed, the drill 124 is moved along the feed track support 122 to withdraw the drill 124 from the bolt hole 128. To provide space to pivot the bolt driver 126 into alignment with the bolt hole 128, the dual-action jack 132 is activated to extend the second piston 140 and retract the first piston 138, thus moving the feed track support 122 away from the rock surface 108 to the position shown in FIG. 3. In this position, the feed track support 122 is sufficiently spaced apart from the rock surface 108 to allow the dual-action jack 132 and the feed track support 122 to be pivoted to bring the bolt driver 126 into alignment with the bolt hole 128, as shown in FIG. 4.

During the drilling and bolting process, the turret assembly 100 is stabilized by a stinger assembly 142 which forcibly engages the rock surface 108. The stinger assembly 142 of this embodiment has a stinger fixed portion 144, which includes a stinger support structure 146 that is affixed to the base 102. Preferably, the stinger assembly 142 also has a stinger extendable portion 148, which can be extended from the stinger fixed portion 144 towards the rock surface 108. In this embodiment, a portion of the stinger assembly 142 is formed by a hydraulic cylinder having a body and an extendable piston, with the piston of the cylinder serving as part of the stinger fixed portion 144 and the body of the cylinder serving as part of the stinger extendable portion 148. When the piston is extended, the stinger extendable portion 148 is forced toward the rock surface 108. Thus, the stinger assembly 142 can be brought into contact with the rock surface 108 without requiring movement of the boom 104.

Preferably, the stinger assembly 142 also includes a rock-engaging pad 150 formed of a resilient material such as urethane. The rock-engaging pad 150 is mounted to the stinger extendable portion 148, when such is employed, and forcibly engages the rock surface 108 when the stinger extendable portion 148 is extended relative to the stinger fixed portion 144. The forcible engagement of the rock-engaging pad 150 with the rock surface 108 stabilizes the base 102 with respect to the rock surface 108 during the drilling and bolt setting operations, as well as providing a fixed reference point for the turret assembly 100 so that the bolt driver 126 can be brought into alignment with the bolt hole 128. It is preferred for the stinger assembly 142 to be positioned on the cylinder axis 114 to provide a fixed pivot axis for the feed track support 122. To provide further stability, the stinger fixed portion 144 can be configured to slidably engage the cylindrical member 112. In this embodiment, since the stinger support structure 146 is affixed to the base 102, the stinger fixed portion 144 must also be rotatable with respect to the cylindrical member 112 to allow the cylindrical member 112 and the attached feed track support 122 to pivot with respect to the base 102.

A pivot actuator 152 is operably connected between the base 102 and the dual-action jack 132 to provide motivating force to pivot the dual-action jack 132 about the cylinder axis 114. Since the feed track support 122 pivots with the dual-action jack 132 as noted above, the pivot actuator 152 serves to pivot the feed track support 122. In this embodiment, the pivot actuator 152 is provided by a linear actuator, such as a hydraulic cylinder, pivotably connected to both the base 102 and the jack body 134 of the dual-action jack 132, and offset from the cylinder axis 114. The throw of the pivot actuator 152 is adjusted such that, after the bolt hole 128 has been bored by the drill 124 while the pivot actuator 152 is extended, as shown in FIGS. 2 and 3, the pivot actuator 152 can be retracted to rotate the feed track support 122 to a position where the bolt driver 126 is aligned with the bolt hole 128, as shown in FIGS. 4 and 5. As noted above, it may be necessary for the dual-action jack 132 to be activated to move the feed track support 122 away from the rock surface 108 (as shown in FIGS. 3 and 4) before pivoting the feed track support 122. After the pivot actuator 152 rotates the feed track support 122 to place the bolt driver 126 into alignment with the bolt hole 128 (as shown in FIG. 4), the dual-action jack 132 is activated to move the feed track support 122 towards the rock surface 108 (as shown in FIG. 5) to allow the bolt driver 126 to insert the rock bolt 106 fully into the bolt hole 128.

After the rock bolt 106 has been installed into the bolt hole 128, the bolt driver 126 is retracted along the feed track support 122 away from the rock surface 108, and the boom 104 can be moved to remove the turret assembly 100 from the vicinity of the rock surface 108. The pivot actuator 152 can then be extended to return the feed track support 122 to its initial position in preparation for drilling a bolt hole at a new location. Since the entire turret assembly 100 is moved away from the rock surface 108, there is no need in this case to activate the dual-action jack 132 before pivoting the feed track support 122. Typically, the stinger extendable portion 148 is retracted before the boom 104 is employed to position the turret assembly 100 in close proximity to a new location for placement of a rock bolt. The stinger extendable portion 148 is then extended to place the rock-engaging pad 150 into forcible engagement with the rock surface at the new location, and the sequence illustrated in FIGS. 2 through 5 is repeated to drill a new bolt hole and install a rock bolt therein.

Figure 6:
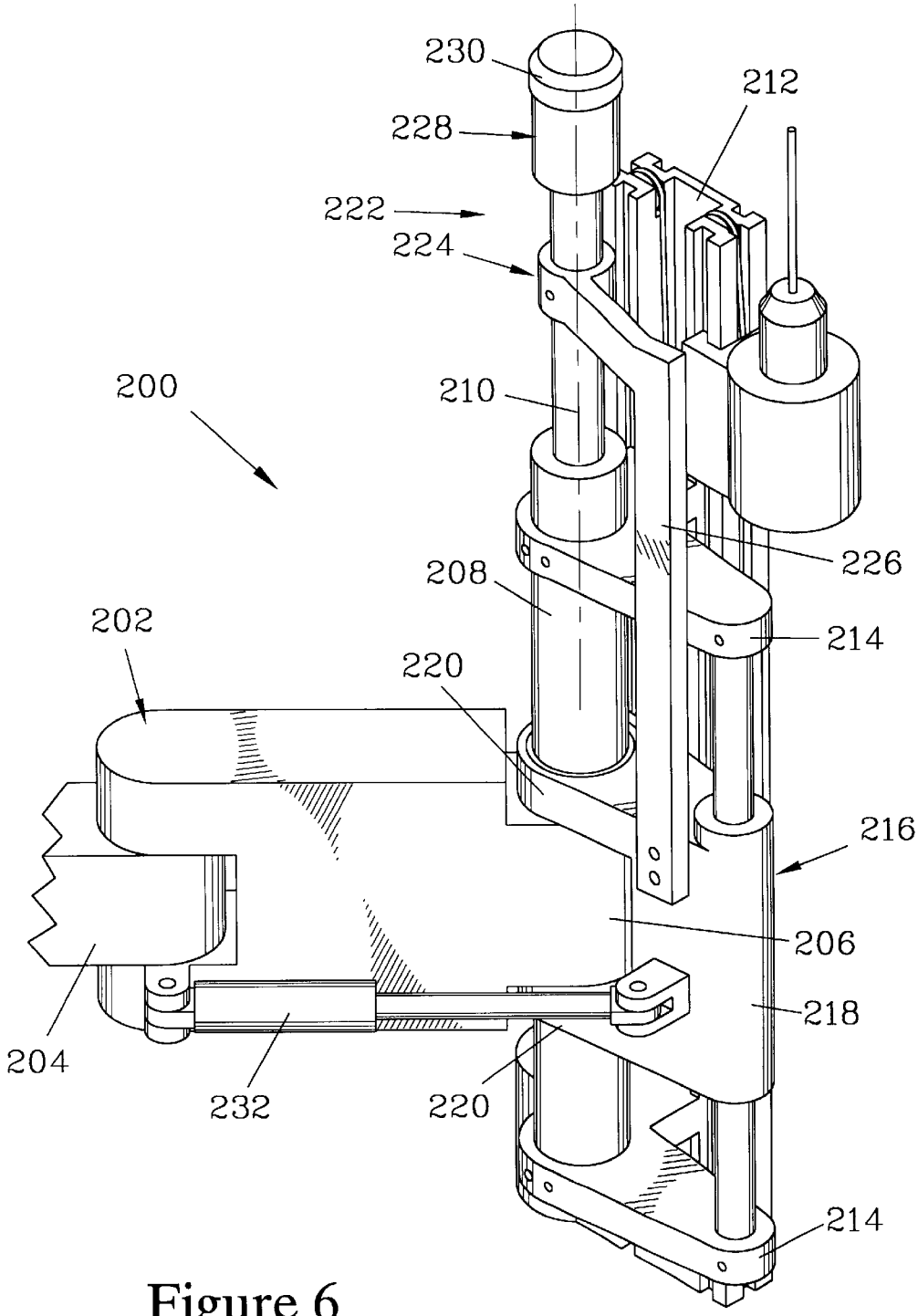
FIG. 6 is an isometric view which illustrates an embodiment similar to that shown in FIGS. 2–5, but where the jack has a pair of bearings which engage the cylindrical element and bracket a single base bearing, and where a stinger assembly of the rock bolter is mounted to the jack, rather than to the base.

FIG. 6 illustrates a turret assembly 200 which forms another embodiment of the present invention, which shares many features in common with the turret assembly 100 shown in FIGS. 2–5. The turret assembly 200 again has a base 202 which is attached at one end to a boom 204 of a rock bolter (not shown). In this embodiment, the base 202 has a single base bearing 206 which is fixably positioned on the base 202 opposite the end which attaches to the boom 204. A cylindrical member 208 is slidably and rotatably mounted to the base bearing 206, and has a longitudinal cylinder axis 210. A feed track support 212 is affixed to the cylindrical member 208 by a pair of brackets 214.

Again, a dual-action jack 216 is employed to provide translational motion for the feed track support 212. The dual-action jack 216 in this embodiment has a jack body 218 having a pair of jack bearings 220 affixed thereto which slidably engage the cylindrical member 208. The jack bearings 220 are positioned to bracket the base bearing 206, and preferably engage the base bearing 206 such that, while the jack body 218 is slidably engaged with respect to the cylindrical member 208, it cannot effectively translate with respect to the base 202. The rotatable engagement between the base bearing 206 and the cylindrical member 208 allows the dual-action jack 216 to pivot with respect to the base 202 about the cylinder axis 210. It should be noted that the use of the pair of jack bearings 220 which engage the base bearing 206 does decrease the stability of the turret assembly 200, since the overall contact region between the base 202 and the cylindrical member 208 is shortened.

The turret assembly 200 is again stabilized during use by a stinger assembly 222 which forcibly engages a rock surface (not shown). In this embodiment, the stinger assembly 222 is mounted to the jack body 218 rather than to the base 202. The stinger assembly 222 has a stinger fixed portion 224, which is affixed to the jack body 218 via a stinger support structure 226, and a stinger extendable portion 228, which can be extended from the stinger fixed portion 224 towards the rock surface. It is again preferred for the stinger assembly 222 to include a rock-engaging pad 230, which in this embodiment is rotatably mounted to the stinger extendable portion 228. The rotational mounting between the rock-engaging pad 230 and the stinger extendable portion 228 allows the stinger extendable portion 228, which is connected to the jack body 218, to rotate freely when the rock-engaging pad 230 is forcibly engaged with the rock surface.

In this embodiment, placing the stinger assembly 222 on the cylinder axis 210 such that the rotational motion between the rock-engaging pad 230 and the stinger extendable portion 228 is about the cylinder axis 210 prevents binding as the feed track support 212 and the dual-action jack 216 are pivoted. It is again preferred for the stinger fixed portion 224 to slidably engage the cylindrical member 208. Since the stinger support structure 226 in this embodiment is affixed to the jack body 218 and pivots with the cylindrical member 208, the stinger fixed portion 224 does not need to be rotatable with respect to the cylindrical member 208.

A pivot actuator 232 is provided, which is pivotably connected between the base 202 and the jack body 218, and which operates in a manner similar to that of the pivot actuator 152 discussed above.

Figure 7:
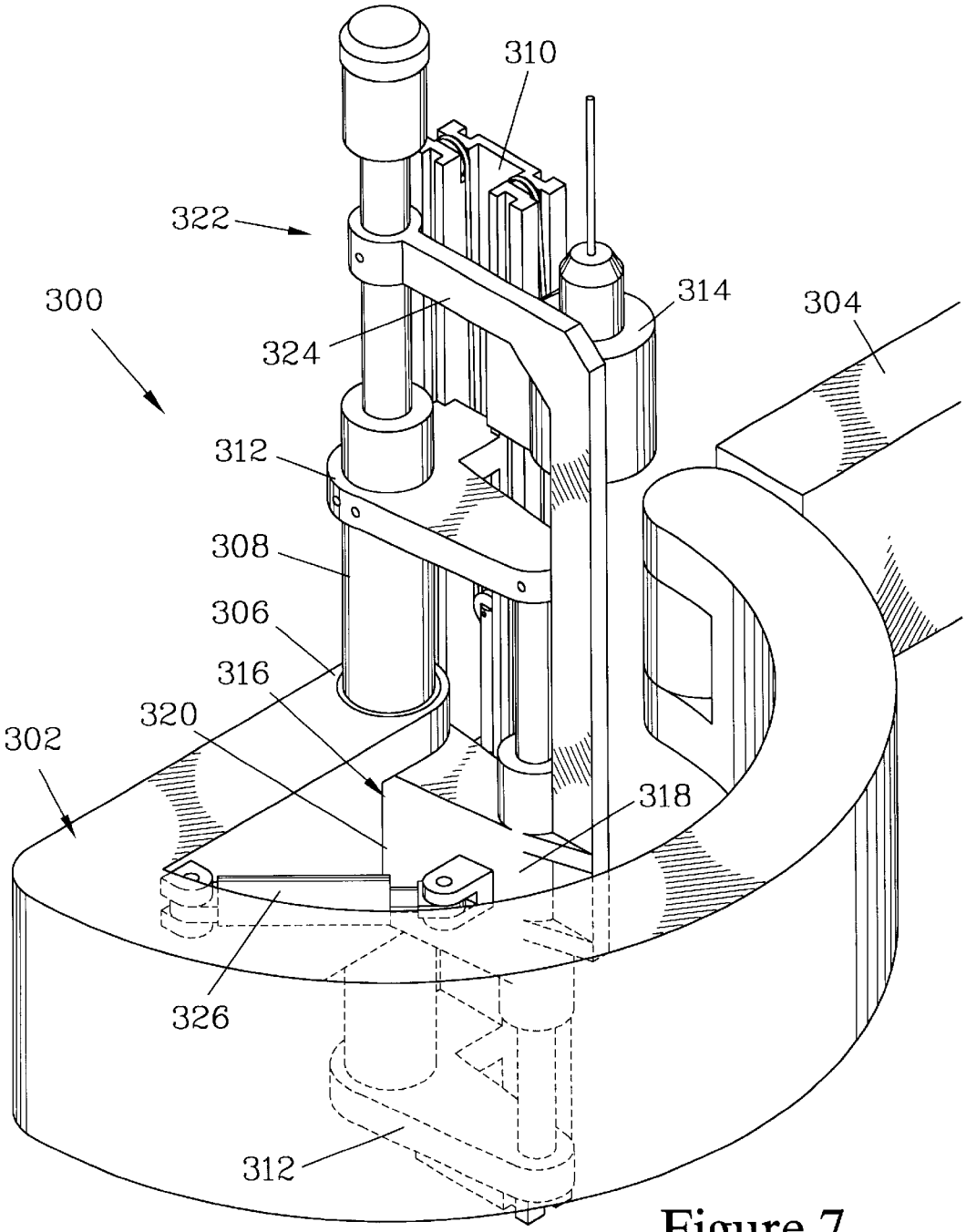
FIG. 7 is an isometric view which illustrates an embodiment that has many features in common with the embodiment shown in FIGS. 2–5, but where a stinger assembly is again mounted to the jack, and where the base is a curved structure to position the feed track support for better visibility by an operator.

FIG. 7 illustrates a turret assembly 300 which forms another embodiment of the present invention, which provides improved visibility for an operator. The turret assembly 300 again has a base 302 which mounts to a boom 304 of a rock bolter (not shown) for positioning the turret assembly 300. The base 302 has a pair of base bearings 306 (only one of which is shown), similar to the base bearings 110 of the embodiment shown in FIGS. 2–5. A cylindrical member 308 is slidably and rotatably mounted to the base bearings 306, and a feed track support 310 is affixed to the cylindrical member 308 by a pair of brackets 312. In this embodiment, the base 302 is curved such that the feed track support 310 faces the boom 304, and thus an operator situated in the direction of the boom 304 can readily view the feed track support 310, as well as the actions of a drill 314 and a bolt driver (not shown) which are movably mounted thereto.

A dual-action jack 316 is provided, having a jack body 318 with a single jack bearing 320 affixed thereto. The jack bearing 320 engages the cylindrical member 308 and the base bearings 306 in a manner similar to the jack bearing 136, the cylindrical member 112, and the base bearings 110 discussed earlier.

A stinger assembly 322 is again provided to stabilize the turret assembly 300 with respect to a rock surface (not shown) during the drilling and bolting operations. In this embodiment, the stinger assembly 322 is mounted to the jack body 318 via a stinger support structure 324, and is essentially similar to the stinger assembly 222 discussed in detail above.

A pivot actuator 326 is provided, which is pivotably connected to the base 302 and to the jack body 318. The pivot actuator 326 can be extended to position the drill 314 for drilling a bolt hole (not shown) into a desired location in the rock surface, and can be retracted to the position illustrated to position the bolt driver into alignment with the bolt hole.

While the novel features of the present invention have been described in terms of particular embodiments and preferred applications, it should be appreciated by one skilled in the art that substitution of materials and modification of details obviously can be made without departing from the spirit of the invention.

What we claim is:

1. A turret assembly for a rock bolter having a boom for positioning the turret assembly with respect to a rock surface into which a bolt hole is to be drilled and a rock bolt installed, the turret assembly comprising:

a base connectable to the boom and having at least one base bearing;

a cylindrical member slidably and rotatably mounted to said at least one base bearing, said cylindrical member having a cylinder axis and terminating in a cylinder first end region and a cylinder second end region;

a pair of spaced apart brackets fixably connected to said cylindrical member and positioned such that said base resides therebetween;

a feed track support affixed on said pair of spaced apart brackets and extending parallel to said cylindrical member;

a drill longitudinally movable with respect to said feed track support for drilling the bolt hole in the rock surface;

a bolt driver longitudinally movable with respect to said feed track support for inserting the rock bolt into the bolt hole drilled by said drill;

an advancement mechanism for selectively moving said drill and said bolt driver along said feed track support;

a jack having at least one jack bearing rotatably and slidably engaged with said cylindrical member, said jack having at least one piston attached to one of said pair of spaced apart brackets;

means for limiting translation between said at least one base bearing and said at least one jack bearing such that said jack is rotatable but not substantially translatable with respect to said base;

a stinger assembly connected to said base and configured for engaging the rock surface; and a pivot actuator operatively connected to said base and to said jack for angularly displacing said jack, thereby rotating said feed track support about said cylinder axis of said cylindrical member and selectively positioning said drill and said bolt driver with respect to the rock surface so as to allow drilling of the bolt hole and thereafter the alignment of said bolt driver with the bolt hole.

2. The turret assembly of claim 1 wherein said jack is a dual-action jack having opposing pistons that are respectively attached to each of said pair of spaced apart brackets.

3. The turret assembly of claim 2 wherein said at least one base bearing further comprises:

a pair of spaced-apart base bearings, and further wherein said means for limiting translation between said at least one base bearing and said at least one jack bearing are provided by configuring said at least one jack bearing to engage each of said pair of spaced-apart base bearings to prevent translational motion with respect thereto along said cylinder axis.

4. The turret assembly of claim 3 wherein said stinger assembly further comprises:

a stinger fixed portion which includes a stinger support structure which is connected to said base; and a stinger extendable portion which can be extended or retracted with respect to said stinger fixed portion in a direction parallel to said cylinder axis.

5. The turret assembly of claim 4 wherein said stinger fixed portion is affixed to said base.

6. The turret assembly of claim 4 wherein said stinger support structure is mounted to said jack, thereby pivotably mounting said stinger assembly with respect to said base, said stinger assembly being positioned on said cylinder axis, and further wherein said stinger extendable portion further comprises:

a rock-engaging pad provided on said stinger extendable portion, said rock-engaging pad being rotatable with respect to said stinger fixed portion about said cylinder axis.

7. The turret assembly of claim 6 wherein said pivot actuator is provided by a linear actuator pivotably connected to said base and to said jack and offset from said cylinder axis.

8. The turret assembly of claim 7 wherein said stinger fixed portion slidably engages said cylindrical member.

9. The turret assembly of claim 8 wherein said base is configured such that said feed track support faces the boom of the rock bolter.

* * * * *